US010773918B2

(12) United States Patent
Hatakeyama et al.

(10) Patent No.: US 10,773,918 B2
(45) Date of Patent: Sep. 15, 2020

(54) SHEET DISCHARGING APPARATUS AND IMAGE FORMING APPARATUS

(71) Applicant: CANON KABUSHIKI KAISHA, Tokyo (JP)

(72) Inventors: Tomoki Hatakeyama, Kashiwa (JP); Jun Agata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 16/218,685

(22) Filed: Dec. 13, 2018

(65) Prior Publication Data

US 2019/0193979 A1 Jun. 27, 2019

(30) Foreign Application Priority Data

Dec. 26, 2017 (JP) ..... 2017-250192

(51) Int. Cl.
*B65H 31/24* (2006.01)
*G03G 15/00* (2006.01)
(Continued)

(52) U.S. Cl.
CPC ..... *B65H 31/24* (2013.01); *B65H 29/14* (2013.01); *B65H 29/34* (2013.01); *B65H 31/02* (2013.01); *B65H 31/3018* (2013.01); *B65H 31/3027* (2013.01); *B65H 31/38* (2013.01); *G03G 15/6541* (2013.01); *B65H 2301/163* (2013.01); *B65H 2301/4212* (2013.01);
(Continued)

(58) Field of Classification Search
CPC ..... B65H 9/101; B65H 29/26; B65H 29/34; B65H 31/24; B65H 31/3018; B65H 31/3009; B65H 31/3054; B65H 31/3063; B65H 31/32
See application file for complete search history.

(56) References Cited

U.S. PATENT DOCUMENTS 6,942,206 B2 * 9/2005 Kuwata ..... B42C 1/12 270/58.08
7,300,045 B2 * 11/2007 Terao ..... B42C 1/12 270/58.08
(Continued)

FOREIGN PATENT DOCUMENTS

JP H08-113420 A 5/1996
JP 2007-153543 A 6/2007
JP 2013-082556 A 5/2013

*Primary Examiner* — Jeremy R Severson
(74) *Attorney, Agent, or Firm* — Venable LLP

(57) ABSTRACT

A sheet discharging apparatus includes a discharging portion, a first supporting portion configured to support the sheet in a state where at least a part of the sheet is exposed to an outside, a second supporting portion configured to support the sheet discharged by the discharging portion, and a control portion configured to execute a first mode and a second mode, the first mode being a mode where the first supporting portion is selected as a destination of the discharged sheet and where the first supporting portion supports the sheet, the second mode being a mode where the second supporting portion is selected as the destination of the discharged sheet and where the second supporting portion supports the sheet by discharging the sheet supported on the first supporting portion to the second supporting portion in a state where the sheet is not supported on the first supporting portion.

16 Claims, 14 Drawing Sheets

(51) Int. Cl.

| | |
|---|---|
| ***B65H 31/38*** | (2006.01) |
| ***B65H 31/30*** | (2006.01) |
| ***B65H 29/14*** | (2006.01) |
| ***B65H 31/02*** | (2006.01) |
| ***B65H 29/34*** | (2006.01) |

(52) U.S. Cl.
CPC ..... *B65H 2301/4213* (2013.01); *B65H 2405/11151* (2013.01); *B65H 2405/11425* (2013.01); *B65H 2801/27* (2013.01)

(56) References Cited

U.S. PATENT DOCUMENTS

| | | | | |
|---|---|---|---|---|
| 8,408,544 | B2 * | 4/2013 | Reinke ..... | H04N 1/00631 271/288 |
| 8,540,229 | B2 | 9/2013 | Tsuji | |
| 9,933,743 | B2 * | 4/2018 | Takahashi ..... | B65H 31/02 |
| 10,099,886 | B2 * | 10/2018 | Yamamoto ..... | B65H 43/00 |
| 10,315,880 | B2 * | 6/2019 | Nakano ..... | B65H 33/08 |

* cited by examiner

SHEET DISCHARGING APPARATUS AND IMAGE FORMING APPARATUS

BACKGROUND OF THE INVENTION

Field of the Invention

The present invention relates to a sheet discharging apparatus for discharging sheets and an image forming apparatus including the sheet discharging apparatus.

Description of the Related Art

Japanese Patent Application Publication No. 2013-82556 proposes a sheet processing apparatus including an intermediate stacking portion on which a sheet is temporarily stacked, a pair of aligning portions which can move relative to each other in a width direction, and a sheet discharging tray disposed below the pair of aligning portions. Each of the aligning portions has a supporting portion to support the lower surface of the sheet, and a vertical portion extending upward from the supporting portion. The vertical portion is provided with a projection portion. Thus, two projection portions contact side edges of the sheet, and the sheet supported by the intermediate stacking portion is aligned in the width direction. When an aligning process and a stapling process for a sheet bundle is completed, the pair of aligning portions retracts outward in the sheet width direction, and the sheet bundle is stacked on the sheet discharging tray.

However, the intermediate stacking portion and the pair of aligning portions described in Japanese Patent Application Publication No. 2013-82556 are used only in post-processes such as the aligning process and the stapling process, and thus are not used when the post-processes are not performed.

SUMMARY OF THE INVENTION

According to one aspect of the present invention, a sheet discharging apparatus includes a discharging portion configured to discharge a sheet in a sheet discharging direction, a first supporting portion configured to support the sheet in a state where at least a part of the sheet is exposed to an outside, a second supporting portion disposed downstream of the first supporting portion in the sheet discharging direction and configured to support the sheet discharged by the discharging portion, and a control portion configured to execute a first mode and a second mode, the first mode being a mode where the first supporting portion is selected as a destination of the discharged sheet and where the first supporting portion supports the sheet, the second mode being a mode where the second supporting portion is selected as the destination of the discharged sheet and where the second supporting portion supports the sheet by discharging the sheet supported on the first supporting portion to the second supporting portion by the discharging portion in a state where the sheet is not supported on the first supporting portion.

Further features of the present invention will become apparent from the following description of exemplary embodiments with reference to the attached drawings.

DESCRIPTION OF THE EMBODIMENTS

Hereinafter, an image forming apparatus of the present disclosure will be described with reference to the accompanying drawings. Examples of the image forming apparatus include printers, copying machines, facsimiles, and multifunction printers having functions of these products.

First Embodiment

Overall Configuration

Figure 1:
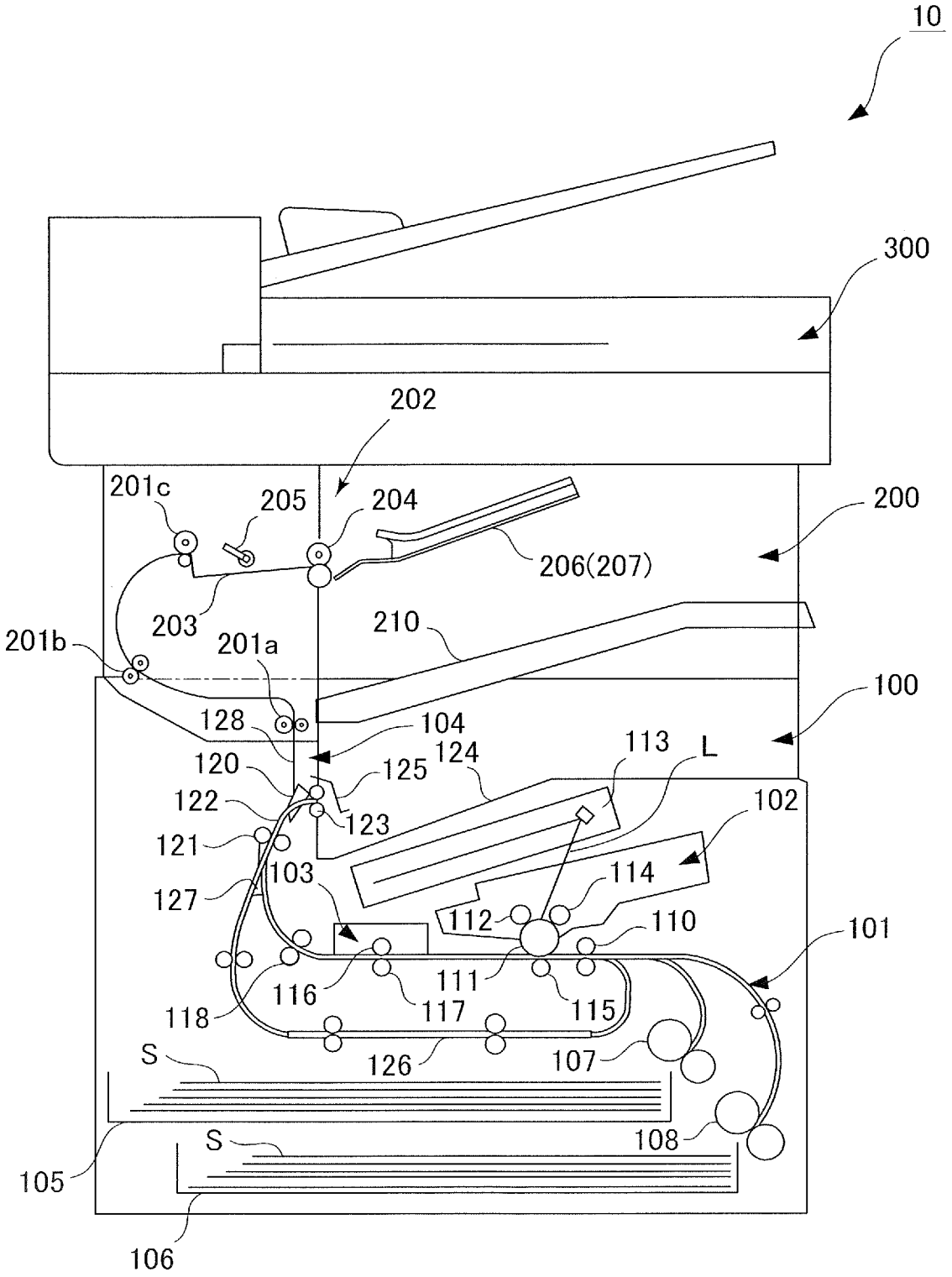
FIG. 1 is an overall schematic diagram of a printer of a first embodiment.

As illustrated in FIG. 1, a printer 10 of the present embodiment, which serves as an image forming apparatus, is a multifunction printer including an image forming apparatus body 100 and a sheet processing apparatus 200. The image forming apparatus body 100 includes an electrophotographic image forming portion 102, and the sheet processing apparatus 200 performs processes, such as stapling, on sheets S on which images are formed.

The sheet processing apparatus 200 is detachably attached to an upper portion of the image forming apparatus body 100, and an image reading apparatus 300 to read image data from a document is disposed above the sheet processing apparatus 200. In the following description, a "front side" and a "back side" are intended to mean the front side and the back side with respect to FIG. 1.

The image forming apparatus body 100 includes the direct-transfer image forming portion 102 which directly transfers a toner image formed on a photosensitive drum 111 to a sheet S. The photosensitive drum 111 is a photosensitive member. Examples of the sheet S include a piece of plain paper; a piece of specialized paper such as coated paper; an envelope; a piece of recording material, such as index paper, which has a specialized shape; and a recording medium which may be a cloth or a plastic film used for overhead projectors.

When the image forming portion 102 is required to start an image forming operation, the photosensitive drum 111 of the image forming portion 102 is rotated. The surface of the photosensitive drum 111 is uniformly charged by a charging apparatus 112, and exposed by an exposure apparatus 113. The exposure apparatus 113 modulates and outputs a laser beam in accordance with image data which is read by the image reading apparatus 300 or sent from a host computer connected with the printer 10 via a network; and forms an electrostatic latent image on the surface of the photosensitive drum 111. The electrostatic latent image is then visualized (developed) by the toner supplied from a developing apparatus 114.

In synchronization with such an image forming operation, a sheet feeding portion 101 performs a feeding operation which feeds the sheet S toward the image forming portion 102. The sheet feeding portion 101 includes sheet supporting apparatuses 105 and 106, and feed rollers 107 and 108. The sheet supporting apparatuses 105 and 106 support sheets S, and may be cassettes. The feed rollers 107 and 108 feed the sheets S supported by the sheet supporting apparatuses 105 and 106. The sheet S sent by the feed roller 107 or 108 is separated, one by one, by a separation mechanism; and conveyed to a registration portion 110. The separation mechanism may be a retard separation system or a separation pad system.

The registration portion 110 corrects skew of the sheet S, and conveys the sheet S toward a transfer roller 115 in synchronization with image forming operation of the image forming portion 102. The transfer roller 115 transfers a toner image carried on the photosensitive drum 111 onto the sheet S by using electrostatic bias, at a transfer nip portion formed between the transfer roller 115 and the photosensitive drum 111. The sheet S on which the unfixed-toner image has been transferred is delivered to a fixing apparatus 103, and heated and pressurized while being held between a fixing roller 116 and a pressure roller 117. With this operation, the toner is melted and fixed to the sheet S. The sheet S on which the fixed image is formed is delivered to a discharging unit 104.

The discharging unit 104 includes a reversing roller pair 121 and a flap-like switching member 120. The reversing roller pair 121 can rotate in a forward or a reverse direction, and the switching member 120 can switch the conveyance direction of the sheet S between a path toward a discharging tray 124 disposed in the body and a path toward the sheet processing apparatus 200. When the sheet S is not processed by the sheet processing apparatus 200, the sheet S is guided toward a discharging roller pair 123 by the switching member 120 and a discharging guide pair 122. The discharging roller pair 123 discharges the sheet S to the discharging tray 124, disposed in an upper portion of the image forming apparatus body 100, in a face down state. Here, the face down state is a state in which a surface of the sheet S on which the toner image is formed faces downward. Above the discharging tray 124 disposed in the body, a full load detecting sensor 125 is disposed to detect a state in which sheets S are fully stacked on the discharging tray 124 disposed in the body. When the image forming apparatus body 100 determines depending on a detection signal from the full load detecting sensor 125 that the amount of stacked sheets exceeds a predetermined value, the image forming apparatus body 100 stops the image forming operation.

On the other hand, when the printer 10 is set so that processes including stapling are performed on the sheet S on which an images is formed, the sheet S is guided toward the later-described sheet processing apparatus 200 by the switching member 120. In addition, also when the printer 10 is set so that any process is not performed on the sheet S, and that the sheet S is discharged to the intermediate tray 203 or the discharging tray 210 of the sheet processing apparatus 200, the switching member 120 guides the sheet S toward the sheet processing apparatus 200.

When duplex printing is performed to form images on both sides of the sheet S, the reversing roller pair 121 rotates in the reverse direction to convey the sheet S in the opposite direction, and the sheet S is guided to a duplex conveyance path 126 by a switching member 127. The sheet S guided to the duplex conveyance path 126 is conveyed to the registration portion 110 again. Then an image is formed on the back side of the sheet S by the image forming portion 102, and the sheet S is conveyed to the discharging tray 124 disposed in the body or the sheet processing apparatus 200 through a path which is selected as appropriate by the switching member 120.

Here, the above-described image forming portion 102 is one example of image forming means to form an image on the sheet S, and may be a tandem-type intermediate-transfer color-image forming portion or an image forming engine (such as an ink-jet image forming system) other than the electrophotographic image forming system.

Sheet Processing Apparatus

Next, the sheet processing apparatus 200 which serves as a sheet discharging apparatus will be described. In the present disclosure, the processing of sheets includes binding process such as stapling, aligning process performed for each sheet or for a predetermined number of sheets, punching, and folding process.

Figure 2:
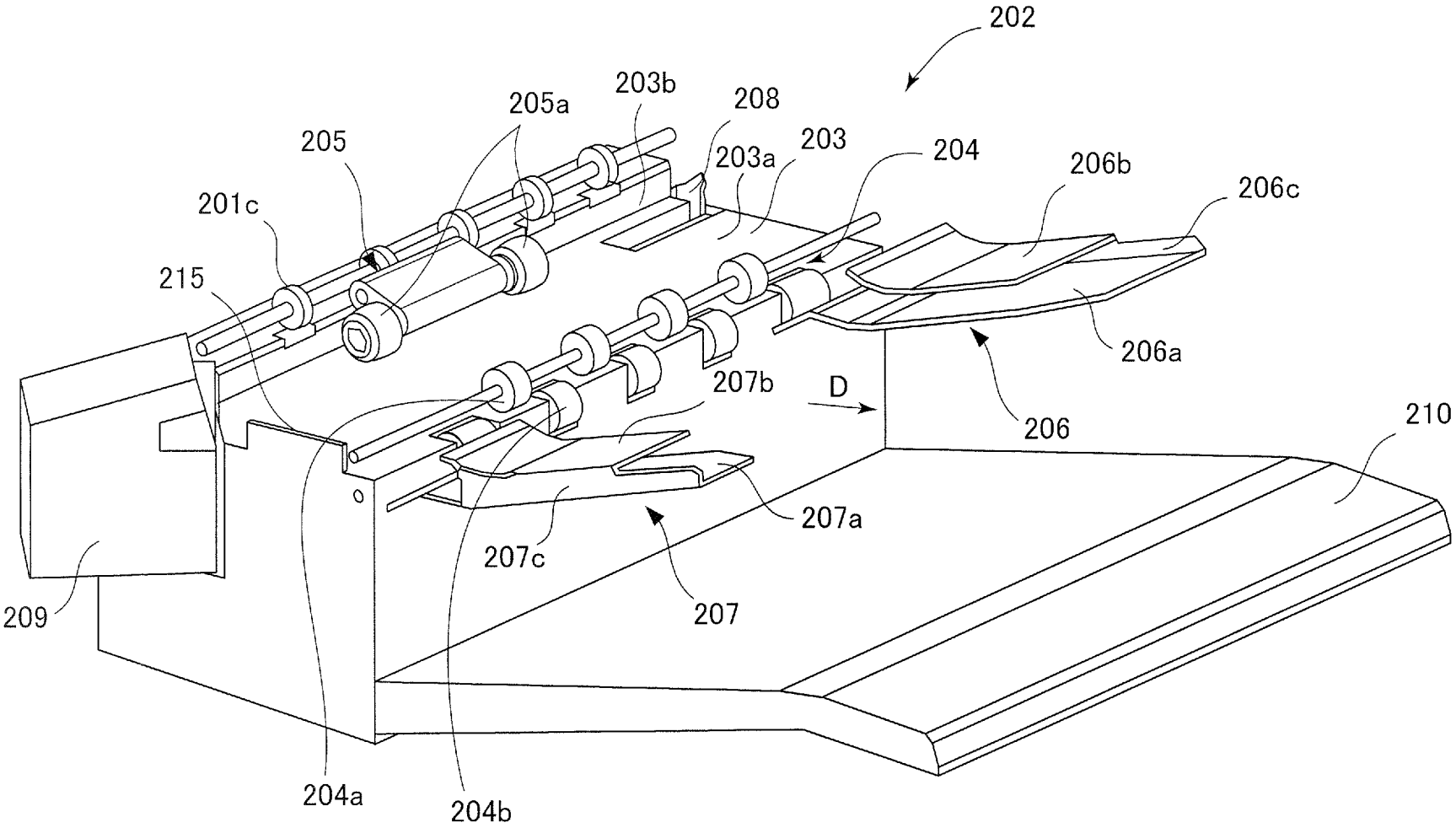
FIG. 2 is a perspective view illustrating a sheet aligning apparatus.

As illustrated in FIGS. 1 and 2, the sheet processing apparatus 200 includes conveyance roller pairs 201*a* to 201*c*, the intermediate tray 203, a discharging-direction aligning portion 205, a pair of aligning members 206 and 207, a discharging roller pair 204, and the discharging tray 210. In addition, the sheet processing apparatus 200 includes a stapler 209, which can perform stapling. The stapler 209 is one example of a processing mechanism to process a sheet supported on the intermediate tray 203. The intermediate tray 203 which is a first supporting portion, the discharging-direction aligning portion 205, and the aligning members 206 and 207 constitute a sheet aligning apparatus 202 which aligns the sheet S.

The conveyance roller pairs 201*a* and 201*b* receive the sheet S, discharged upward from the image forming apparatus body 100, and deliver the sheet S to the conveyance roller pair 201*c*. The conveyance roller pair 201*c* which is a first discharging portion further delivers the sheet S to the sheet aligning apparatus 202. The sheet aligning apparatus 202 causes the intermediate tray 203 and the aligning members 206 and 207 to support the sheet S, and causes the discharging-direction aligning portion 205 and the aligning members 206 and 207 to align the sheet S so that the sheet S is positioned at a target aligning position. Here, the target aligning position is a sheet position which is set in accordance with a corresponding process. For example, when the stapling is performed, the target aligning position is set in accordance with a binding position of the stapler 209.

As illustrated in FIG. 2, the discharging-direction aligning portion 205 is disposed above the intermediate tray 203, and includes friction rollers 205*a* and 205*a*. The friction rollers 205*a* and 205*a* can rotate around an axis extending in a direction orthogonal to a sheet discharging direction (arrow D), that is, in a width direction of the sheet S. The discharging-direction aligning portion 205 can move between an abutment position at which the friction rollers 205*a* and 205*a* abut against the upper surface of the sheet S supported on the intermediate tray 203 and a separation position at which the friction rollers 205*a* and 205*a* are separated upward from the sheet S. The discharging-direction aligning portion 205 is moved up and down between the abutment position and the separation position by the driving force of a first motor M1 (see FIG. 5).

The intermediate tray 203 which supports the sheet S to be processed by the sheet processing apparatus 200 has a supporting surface 203*a* and a first reference wall 203*b*. The supporting surface 203*a* supports an upstream portion of the sheet S in the conveyance direction, and the first reference wall 203*b* extends upward from an upstream edge of the supporting surface 203*a*. Both sides of the intermediate tray 203 in the width direction are provided with a second reference wall 208 and a third reference wall 215. The second reference wall 208 is linked with the aligning member 206 via a link mechanism (not illustrated) so that the second reference wall 208 moves with the aligning member 206.

The aligning members 206 and 207 constitute a pair of aligning members. The aligning member 206 which is a first aligning member 206 is disposed on the back side with respect to the sheet processing apparatus 200, that is, on one side in the width direction. The aligning member 207 which is a second aligning member 207 is disposed on the front side with respect to the sheet processing apparatus 200, that is, on the other side in the width direction. Each of the aligning members 206 and 207 has a cross section which is C-shaped and opened toward a center position between the aligning members 206 and 207 in the width direction, when viewed from the sheet discharging direction. In other words, the aligning member 206 has a side wall 206*c* which faces one side edge of the sheet S, that is, one edge portion of the sheet S in the width direction; and the aligning member 207 has a side wall 207*c* which faces the other side edge of the sheet S, that is, the other edge portion of the sheet S in the width direction. A supporting lower surface 206*a* extends from the lower edge of the side wall 206*c* toward the center position in the width direction, and a supporting upper surface 206*b* extends from the upper edge of the side wall 206*c* toward the center position in the width direction. A supporting lower surface 207*a* extends from the lower edge of the side wall 207*c* toward the center position in the width direction, and a supporting upper surface 207*b* extends from the upper edge of the side wall 207*c* toward the center position in the width direction.

Figure 3:
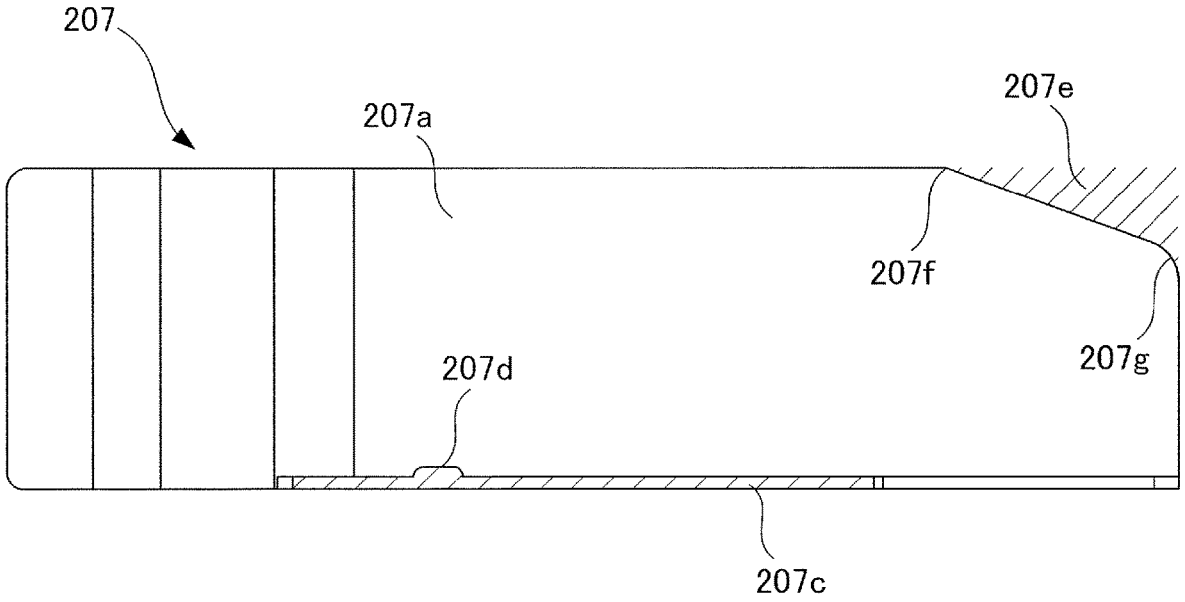
FIG. 3 is a plan view illustrating a second aligning member.
Figure 4:
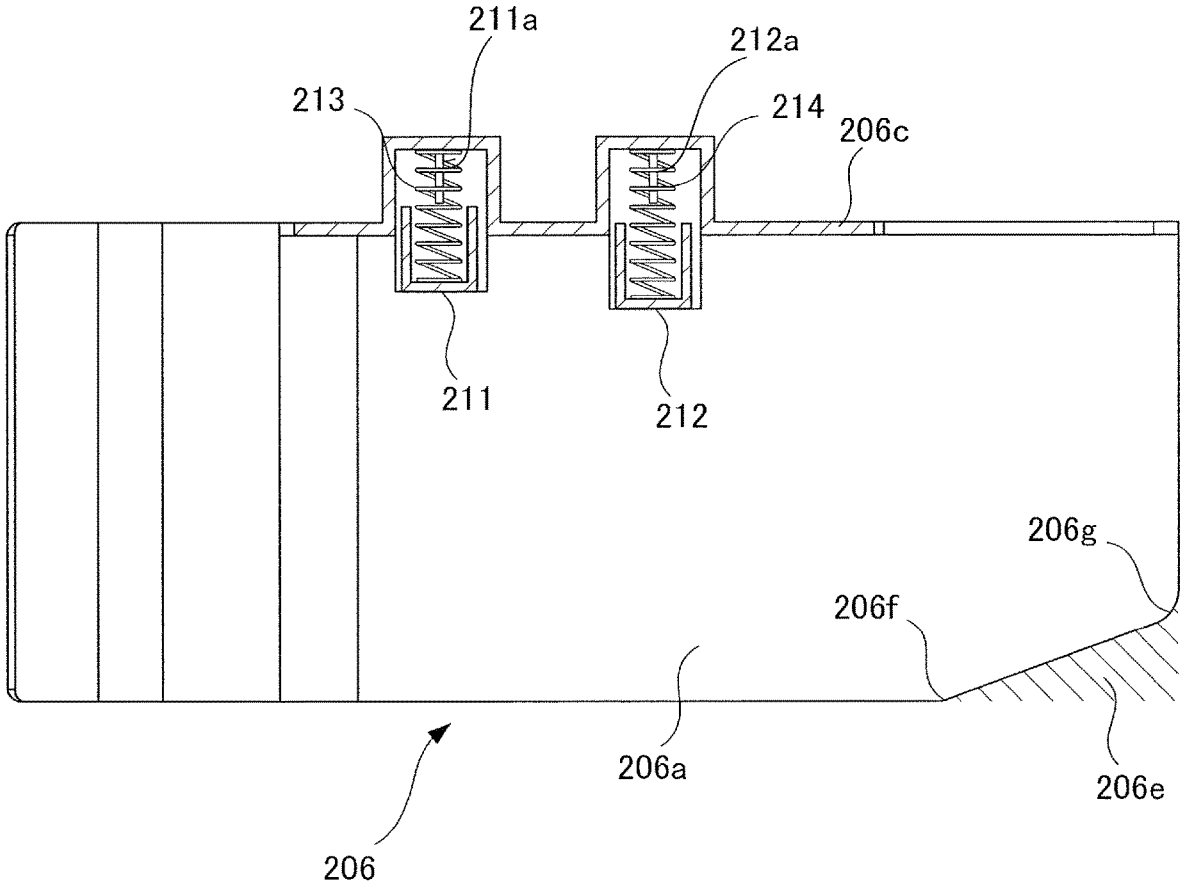
FIG. 4 is a plan view illustrating a first aligning member.

As illustrated in FIGS. 3 and 4, the side wall 207*c* of the second aligning member 207 is provided with a fourth reference wall 207*d* which protrudes toward the center position in the width direction, and the first aligning member 206 is provided with two pressing members 211 and 212 which protrude from the side wall 206*c* toward the center position in the width direction. The pressing member 211 is supported so that the pressing member 211 can move along a guide portion 211*a* in the width direction, and is urged by an elastic member 213 toward the center position in the width direction. The pressing member 212 is supported so that the pressing member 212 can move along a guide portion 212*a* in the width direction, and is urged by an elastic member 214 toward the center position in the width direction. In a natural state of the pressing members 211 and 212 where the sheet S is not pressed by the pressing members 211 and 212, the pressing member 212 protrudes slightly closer to the center position in the width direction, than the pressing member 211.

As illustrated in FIGS. 2 to 4, the fourth reference wall 207*d* of the second aligning member 207 contacts one side edge of the sheet S, and the pressing members 211 and 212 of the first aligning member 206 contact the other side edge of the sheet S. That is, the fourth reference wall 207*d* and the side wall 207*c* are an abutment surface against which the sheet S can abut, and the pressing members 211 and 212 and the side wall 206*c* are also an abutment surface against which the sheet S can abut. Here, only the side wall 206*c* of the first aligning member 206 and the side wall 207*c* of the second aligning member 207 may contact the side edges of the sheet S. The supporting lower surfaces 206*a* and 207*a* are lower-surface supporting portions which face the lower surface of the sheet S which is in contact with the abutment surfaces.

Figure 5:
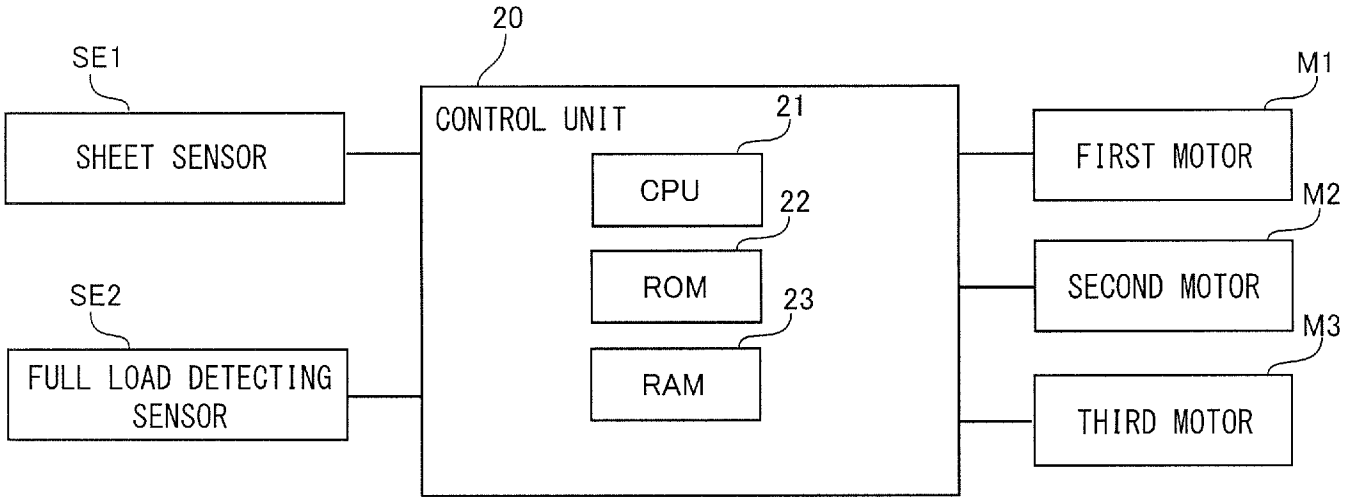
FIG. 5 is a control block diagram of the first embodiment.

The aligning members 206 and 207 can be moved relative to each other in the width direction by the driving force of a second motor M2 (see FIG. 5). Each of the aligning members 206 and 207 can move between a retracting position (for example, a position illustrated in FIG. 8D) and an aligning position (for example, a position illustrated in FIG. 7). The retracting position is a position to which each of the aligning members 206 and 207 retracts in the width-direction, outside the sheet S discharged by the discharging roller pair 204. The aligning position corresponds to the target aligning position of the sheet S. In addition, each of the aligning members 206 and 207 can also move to a sheet receiving position (see FIG. 6A) which is a holding position between the retracting position and the aligning position. Here, the aligning position is a position which is set in accordance with a sheet width of the sheet S, so that the abutment surfaces of the aligning members 206 and 207 contact the side edges of the sheet S when the sheet S is positioned at the target aligning position.

As illustrated in FIG. 2, the discharging roller pair 204 is one example of a second discharging portion which discharges the sheet aligned by the sheet aligning apparatus 202, and is disposed between the intermediate tray 203 and the aligning members 206 and 207 in the sheet discharging direction. The discharging tray 210 is one example of a second supporting portion which supports the sheet discharged by the discharging roller pair 204, and is disposed below the aligning members 206 and 207. The discharging roller pair 204 is a so-called comb-teeth roller pair in which a plurality of upper rollers 204*a* and a plurality of lower rollers 204*b* are alternately disposed in the width direction, and in which outer circumferential portions of the plurality of upper rollers 204*a* partly overlap with outer circumferential portions of the plurality of lower rollers 204*b* when viewed from the width direction. The upper rollers 204*a* and the lower rollers 204*b* can move relative to each other in the vertical direction. Thus, the discharging roller pair 204 can be switched between a close state and an open state. The close state is a first state in which the discharging roller pair 204 can hold and convey the sheet S. The open state is a second state in which the upper rollers 204*a* and the lower rollers 204*b* are separated from each other in the vertical direction. In the open state, the discharging roller pair 204 cannot hold the sheet S. In the present embodiment, the upper rollers 204*a* which serve as a second rotary member can be contacted to or separated from the lower rollers 204*b* which serve as a first rotary member, by the driving force of a third motor M3 (see FIG. 5). However, the discharging roller pair 204 may not be a comb-teeth roller pair, and the upper rollers 204*a* and the lower rollers 204*b* may form a nip.

Control Block

FIG. 5 is a control block diagram of the present embodiment. The control block of FIG. 5 may be partly or wholly disposed in the sheet processing apparatus 200, or disposed in the image forming apparatus body 100. A control portion 20 controls the system of the printer 10, and includes a CPU 21, a ROM 22, and a RAM 23. The CPU 21 is connected, via an address bus and a data bus, with the ROM 22 in which a control program is written, and with the RAM 23 in which data used for the control is written.

Input terminals of the control portion 20 are connected with a sheet sensor SE1 which detects whether the discharging tray 210 supports sheets, and with a full load detecting sensor SE2 which determines whether sheets are fully stacked on the discharging tray 210. Output terminals of the control portion 20 are connected with the first motor M1, the second motor M2, and the third motor M3.

Sheet Aligning Operation

Figure 6A:
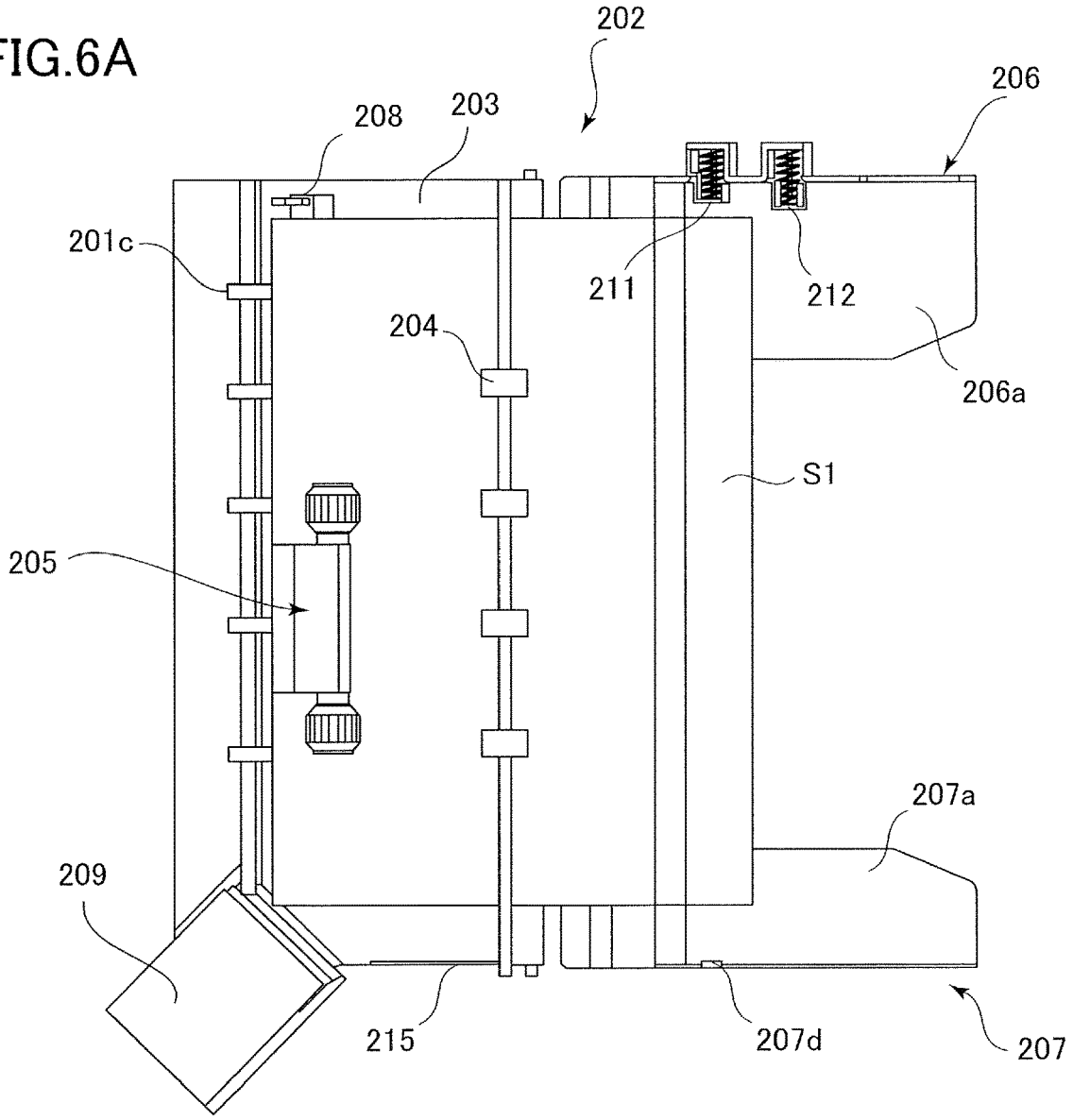
FIG. 6A is a plan view for illustrating a sheet aligning operation performed on A4-size sheets.
Figure 6B:
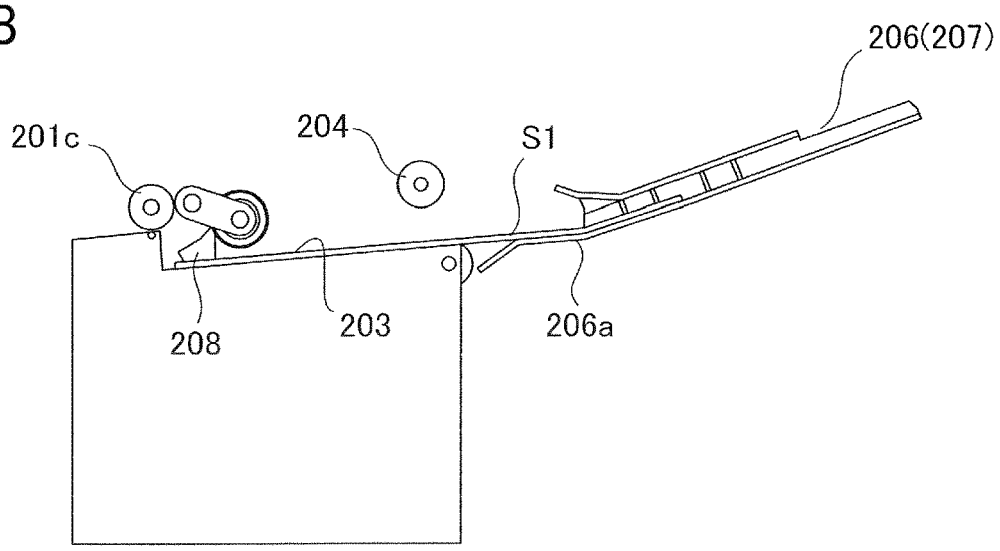
FIG. 6B is a side view for illustrating the sheet aligning operation performed on A4-size sheets.
Figure 7:
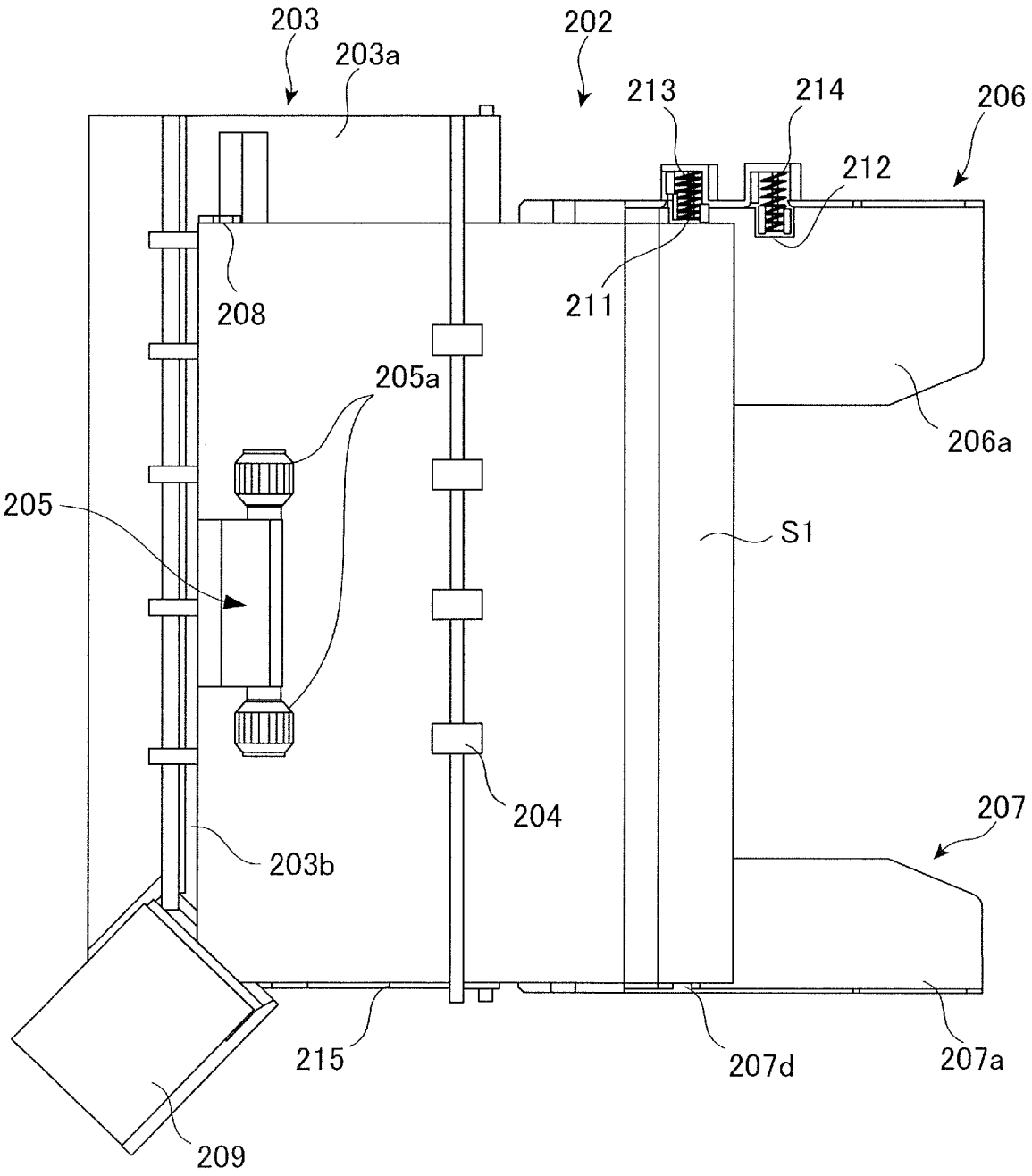
FIG. 7 is a plan view illustrating a state where the sheet aligning operation has been completed.
Figure 8A:
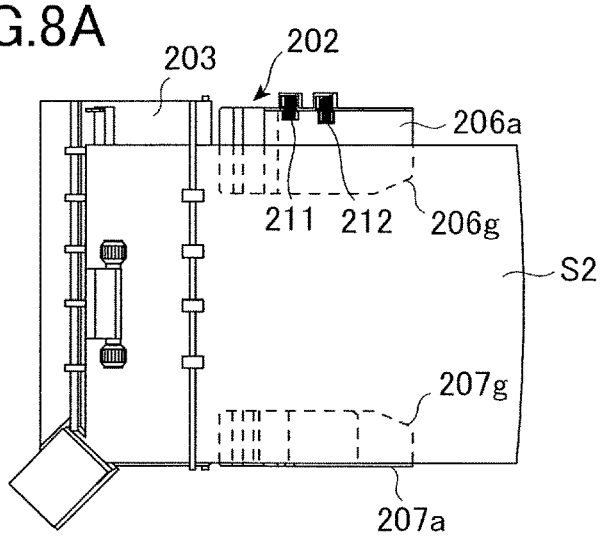
FIG. 8A is a plan view for illustrating a sheet aligning operation performed on A3-size sheets.
Figure 8B:
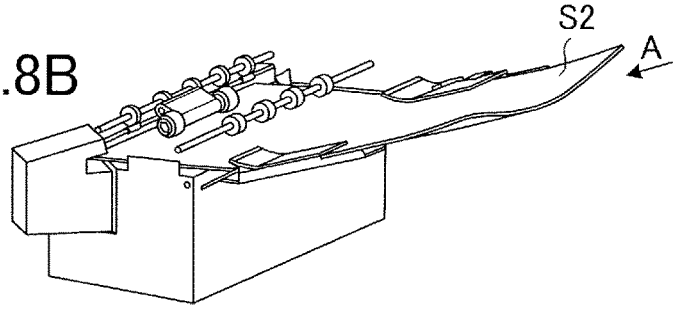
FIG. 8B is a perspective view for illustrating the sheet aligning operation performed on A3-size sheets.
Figure 8C:
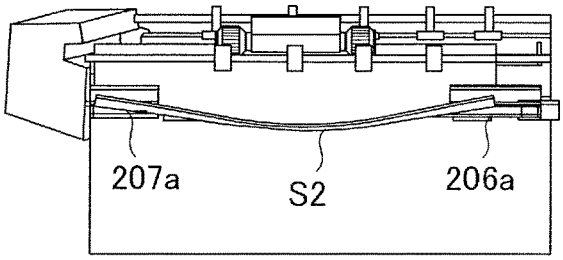
FIG. 8C illustrates the sheet aligning apparatus as viewed from an A-direction of FIG. 8B.
Figure 8D:
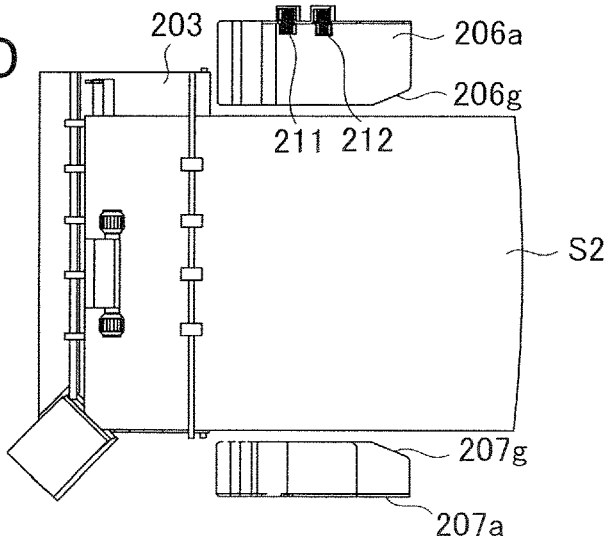
FIG. 8D is a plan view illustrating the aligning members positioned at a retracting position.

With reference to FIGS. 6A to 8D, a sheet aligning operation of the sheet aligning apparatus 202 having the above-described configuration will be described. FIGS. 6A, 7, 8A, and 8D are plan views in which main parts of the sheet processing apparatus 200 are viewed from above. For convenience of description, the supporting upper surfaces 206*b* and 207*b* of the aligning members 206 and 207 are omitted in the figures. In addition, FIGS. 6A to 7 illustrate states where an A4-size sheet S1 is conveyed into the sheet aligning apparatus 202, and FIGS. 8A to 8D illustrate states where an A3-size sheet S2 is conveyed into the sheet aligning apparatus 202.

First, with reference with FIGS. 6A to 7, a sheet aligning operation performed when the A4-size sheet S1 is conveyed into the sheet aligning apparatus 202 will be described. When the sheet aligning operation of the sheet aligning apparatus 202 is requested, the aligning members 206 and 207 are moved in advance toward the center position in the width direction, and positioned at a sheet receiving position, as illustrated in FIG. 6A, at which the supporting lower surfaces 206*a* and 207*a* can support the lower surface of the sheet S. At this time, the fourth reference wall 207*d* of the second aligning member 207 is substantially flush with the third reference wall 215. In addition, the first aligning member 206 is positioned at a position at which the pressing members 211 and 212 do not prevent the conveyance of the sheet S1.

The pressing member 212 is not used when the A4-size sheet S1 is aligned, but used when the A3-size sheet S2 is aligned, as described later. In addition, as illustrated in FIG. 6B, a downstream edge of the sheet S1 in the sheet discharging direction is supported by the aligning members 206 and 207, and thus the sheet S1 is placed on the aligning members 206 and 207 in a state where a center portion of the sheet S1 does not bend and protrude downward, and where the sheet S1 is substantially flat.

Then the sheet aligning apparatus 202 waits until the sheet S1 is conveyed into the sheet aligning apparatus 202, in a state where the friction rollers 205*a* and 205*a* of the discharging-direction aligning portion 205 are positioned at the separation position, and where the discharging roller pair 204 is kept in the open state. When the sheet S1 is conveyed into the sheet aligning apparatus 202 by the conveyance roller pair 201*c*, the sheet S1 is supported on the intermediate tray 203 and the aligning members 206 and 207. That is, an upstream portion of the sheet S1 in the conveyance direction is supported by the supporting surface 203*a* of the intermediate tray 203, and side portions (in the width direction) of a downstream portion (in the conveyance direction) of the sheet S1 are supported on the supporting lower surfaces 206*a* and 207*a* of the aligning members 206 and 207. In this state, the sheet aligning operation of the sheet aligning apparatus 202 is started.

First, the first aligning member 206 is moved toward the second aligning member 207 by the driving force of the second motor M2. Then, as illustrated in FIG. 7, the pressing member 211 pushes one edge of the sheet S1 in the width direction, moves the sheet S1 toward the third reference wall 215 and the fourth reference wall 207*d*, and thereby aligns the sheet S1. Since the second reference wall 208 moves in synchronization with the first aligning member 206, the sheet S1 is aligned in the width direction by the second reference wall 208, the third reference wall 215, the fourth reference wall 207*d*, and the pressing member 211. Like the pressing member 211, the second reference wall 208 is supported so that the second reference wall 208 can move in the width direction, and is urged by an elastic member toward a center position in the width direction.

The fourth reference wall 207*d* of the second aligning member 207 and the pressing member 211 align a downstream edge portion of the sheet S1, which is in the sheet discharging direction; and the second reference wall 208 and the third reference wall 215 align an upstream edge portion of the sheet S1, which is in the sheet discharging direction. Thus, when aligned, the sheet S1 can be moved in the width direction, without being rotated.

In addition, the first aligning member 206 moves to a position at which a gap between the supporting lower surfaces 206*a* and 207*a* in the width direction becomes smaller than a length of the sheet S1 in the width direction. With this operation, even when an apparent length of the sheet S1 is shortened due to tolerance of components and sheet width, or curl, the edge portion of the sheet S1 in the width direction can reliably reach the third reference wall 215 and the fourth reference wall 207*d*, keeping high aligning accuracy for the sheet S1. Here, the elastic force of the elastic members 213 and 214 is set so that the elastic force does not damage the sheet S1 after the edge portion of the sheet S1 in the width direction reaches the third reference wall 215 and the fourth reference wall 207*d*. Thus, when the sheet S1 pushes back the pressing member 211, the pressing member 211 moves outward in the width direction, and contracts from its natural state. As a result, a positional difference between the pressing members 211 and 212 in the width direction becomes larger.

When the aligning operation in the width direction for the sheet S1 is completed, the aligning operation in the sheet discharging direction is started. The friction rollers 205*a* and 205*a* of the discharging-direction aligning portion 205 move to the abutment position, rotates in a direction opposite to the sheet discharging direction, and thereby causes the trailing edge of the sheet S1 to abut against the first reference wall 203*b* of the intermediate tray 203. Then the friction rollers 205*a* and 205*a* move to the separation position, and the aligning members 206 and 207 move to the sheet receiving position and wait until a following sheet is conveyed into the sheet aligning apparatus 202. Here, in the vicinity of the intermediate tray 203, a holding member (not illustrated) is disposed to hold the sheet S1 between the holding member and the supporting surface 203*a* of the intermediate tray 203. Thus, once aligned, the sheet S1 is kept in an aligned state.

The above-described aligning operation for the single sheet S1 is repeated until a series of jobs to discharge sheets is completed. Then, the stapler 209 performs a binding process on a sheet bundle supported on the intermediate tray 203 and the aligning members 206 and 207. After that, the discharging roller pair 204 enters the close state; the aligning members 206 and 207 move to the retracting position, which is the separation position; and the discharging roller pair 204 rotates to stack the processed sheet bundle on the discharging tray 210.

Here, the order of operations of the discharging-direction aligning portion 205 and the aligning members 206 and 207 may be reversed. That is, the discharging-direction aligning portion 205 may align the sheet S1, earlier in the sheet discharging direction, and then the aligning members 206 and 207 may align the sheet S1 in the width direction. In addition, when the sheet S1 is moved upstream in the sheet discharging direction and aligned as in the present embodiment, it is desirable that the sheet S1 is supported in a state where a downstream portion of the sheet S1 in the sheet discharging direction is raised with respect to an upstream portion of the sheet S1. With this configuration, the sheet S1 can slide upstream in the sheet discharging direction, due to the weight of the sheet S1 itself.

Next, a supported state of the A3-size sheet S2 conveyed into the sheet aligning apparatus 202 will be described with reference to FIGS. 8A to 8D. Here, the aligning operation for the A3-size sheet is the same as that for the A4-size sheet. As illustrated in FIGS. 8A and 8B, when the A3-size sheet S2 is conveyed into the sheet aligning apparatus 202, a downstream edge portion of the sheet S2 in the sheet discharging direction is not supported by the aligning members 206 and 207. In addition, as illustrated in FIG. 8C, when the aligning members 206 and 207 are positioned at a sheet receiving position or an aligning position, a center portion of the sheet S2 in the width direction bends and protrudes downward. That is, the sheet S2 is U-shaped. Since the sheet S2 is supported so as to be U-shaped, a downstream portion of the sheet S2 in the sheet discharging direction does not hang because of to the stiffness of the sheet S2, even though the downstream portion is not supported by the aligning members 206 and 207. Thus, even when a long sheet is used, the sheet can be supported on the intermediate tray 203 and the aligning members 206 and 207.

When the downstream portion of the sheet S2 is supported so as to be U-shaped in this manner, an apparent width of the downstream portion of the sheet S2 becomes shorter than the nominal value. In addition, as described for the aligning operation performed on the A4-size sheet S1 in the width direction, when the aligning operation is performed, it is desirable for preventing rotation of the sheet that an upstream portion and a downstream portion of the sheet in the sheet discharging direction are pushed at their side edges. Here, the upstream portion and the downstream portion are disposed, with a center of gravity of the sheet being interposed between the upstream portion and the downstream portion in the sheet discharging direction.

Based on the above-described two points, it is preferable that the pressing member 212 protrudes closer to a center point in the width direction, than the pressing member 211. The amount of protrusion of the pressing member 212 with respect to the pressing member 211 is required to be larger than the amount by which an apparent width of the sheet becomes shorter by supporting the sheet so as to be U-shaped. This is because, for preventing rotation of the A3-size sheet S2 in the alignment, the pressing member 212 is required to contact the side edge of the sheet S2 in the width direction, earlier than the pressing member 211. If the sheet S2 was rotated by the pressing member 212, the rotation would hardly produce negative effect on the alignment of the sheet S2, because the sheet S2 would be rotated in a direction (clockwise in FIG. 8A) in which an upstream edge portion of the sheet S2 moves closer to the first reference wall 203*b*.

However, if the pressing member 212 is disposed downstream in the sheet discharging direction and excessively separated from the pressing member 211, the U-shape of the sheet S2 may cause the side edges of the sheet S2 to move upward when the first aligning member 206 moves toward the second aligning member 207 in the aligning operation for the sheet S2. Thus, it is preferable that the U-shape is formed in the sheet S2 from a position slightly downstream of the pressing member 211 in the sheet discharging direction.

In addition, in the present embodiment, a cutout 207*e* is formed in the supporting lower surface 207*a*, as illustrated in FIG. 3. Specifically, the cutout 207*e* is formed in a portion of the supporting lower surface 207*a* on the downstream edge side in the sheet discharging direction, and on the center side in the width direction. The cutout 207*e* has an edge line which connects a point 207*f* and a point 207*g*, and along which the cutout 207*e* is cut out. Similarly, a cutout 206*e* is formed in the supporting lower surface 206*a*, as illustrated in FIG. 4. Specifically, the cutout 206*e* is formed in a portion of the supporting lower surface 206*a* on the downstream edge side in the sheet discharging direction, and on the center side in the width direction. The cutout 206*e* has an edge line which connects a point 206*f* and a point 206*g*, and along which the cutout 206*e* is cut out. With the cutouts 206*e* and 207*e* formed in this manner in the supporting lower surfaces 206*a* and 207*a*, a center portion of the sheet in the width direction can easily bend and protrude downward.

Preferably, an upstream portion of the sheet S2 in the sheet discharging direction is flat so as to allow the stapler 209 to highly precisely perform the binding process, and only a downstream portion of the sheet S2 is U-shaped. Thus, the cutouts 206*e* and 207*e* are widened in the width direction as the cutouts 206*e* and 207*e* extend downward in the sheet discharging direction. The sheet S2 is supported in a state where the sheet S2 is in contact with the edge line connecting the points 206*f* and 206*g*, and with the edge line connecting the points 207*f* and 207*g*; and thus is U-shaped. Preferably, the points 206*g* and 207*g* are positioned closer to the center position in the width direction, than the side edges of the sheet in the width direction, which is conveyed into the sheet aligning apparatus 202.

Figure 9A:
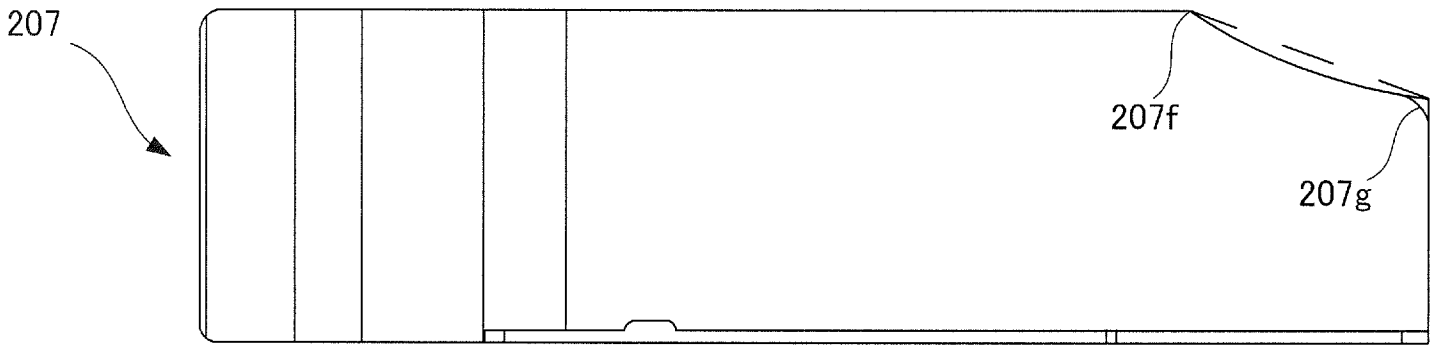
FIG. 9A is a plan view illustrating a modification of the second aligning member.
Figure 9B:
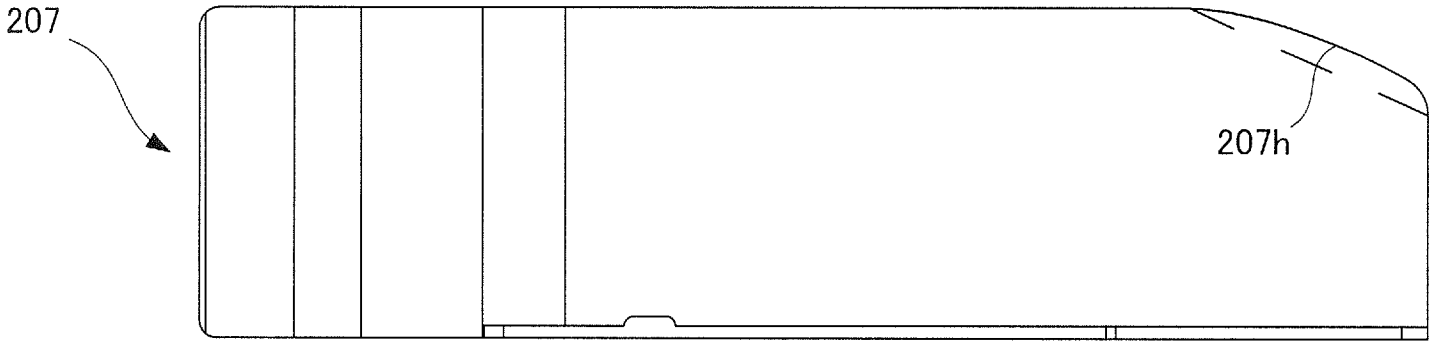
FIG. 9B is a plan view illustrating another modification of the second aligning member.

Here, the shape of the cutouts 206*e* and 207*e* of the aligning members 206 and 207 is not limited to the shape formed by connecting the points 206*f* and 206*g* by using a straight line, and the shape formed by connecting the points 207*f* and 207*g* by using a straight line. For example, as illustrated in FIGS. 9A and 9B, the shape of the cutout 207*e* may be formed by connecting the points 207*f* and 207*g* by using a curved line. However, when the second aligning member 207 is formed as illustrated in FIG. 9B, it is difficult to stably support the sheet because only a contact point 207*h* contacts the sheet. For this reason, the second aligning member 207 is preferably formed as illustrated in FIG. 9A.

The above-described sheet aligning operation has been described for the A4-size and A3-size sheets for example, but is not limited to the operation for these two size sheets. For example, the present invention is also applicable for a sheet processing apparatus which can align sheets having, for example, the LTR size, the LDR size, and other sheet sizes.

Holding Mode and Stacking Mode

Next, a holding mode and a stacking mode which are main features of the present invention will be described. In the above-described sheet aligning operation, the aligning process and the binding process are performed on sheets discharged to the intermediate tray 203 and the aligning members 206 and 207. In the present embodiment, however, even when these processes are not performed, sheets can be discharged to and supported on the intermediate tray 203 and the aligning members 206 and 207.

Figure 10A:
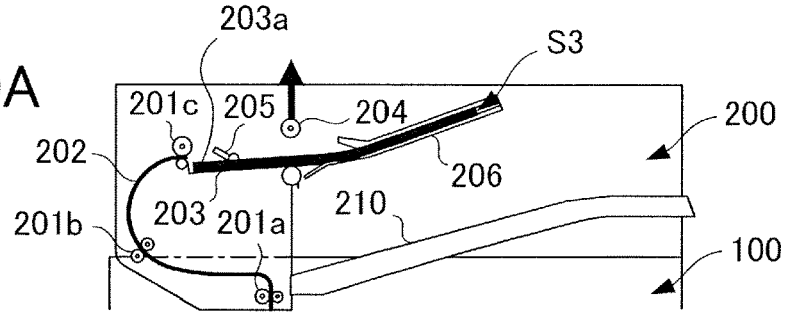
FIG. 10A is a side view for illustrating a holding mode.

As illustrated in FIG. 10A, in the holding mode, when a sheet discharging job (for example, an image forming job which forms an image on a sheet and discharges the sheet to the sheet processing apparatus 200) is inputted, the intermediate tray 203 is selected as a destination of the discharged sheet. In the holding mode, when the job is completed, the sheet is supported on the intermediate tray 203 and the aligning members 206 and 207. More specifically, when the control portion 20 (see FIG. 5) executes the holding mode serving as a first mode, the discharging roller pair 204 enters the open state, and the aligning members 206 and 207 are positioned at the sheet receiving position. In this state, a sheet S3 is discharged by the conveyance roller pair 201*c* to the intermediate tray 203 and the aligning members 206 and 207. Here, the discharging roller pair 204 may be in the close state, provided that the discharging roller pair 204 is in the open state while the sheet S3 conveyed by the conveyance roller pair 201*c* is passing through between the upper rollers 204*a* and the lower rollers 204*b* of the discharging roller pair 204. The length of the supporting surface 203*a* of the intermediate tray 203 in the sheet discharging direction is shorter than the length of a minimum-size sheet which is applicable for the sheet processing apparatus 200. Consequently, at least a part of the sheet S3 supported on the intermediate tray 203 and the aligning members 206 and 207 is exposed to the outside. Thus, the sheet S3 supported on the intermediate tray 203 and the aligning members 206 and 207 can be taken out by a user.

Figure 10B:
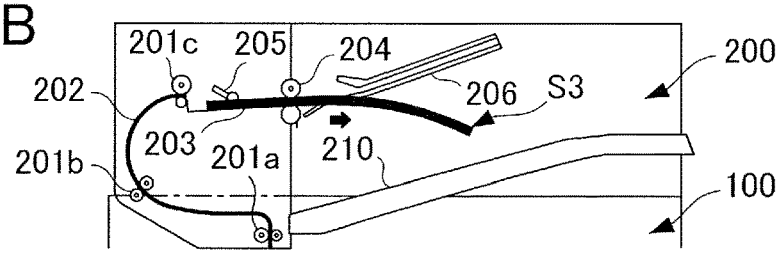
FIG. 10B is a side view for illustrating a stacking mode.
Figure 10C:
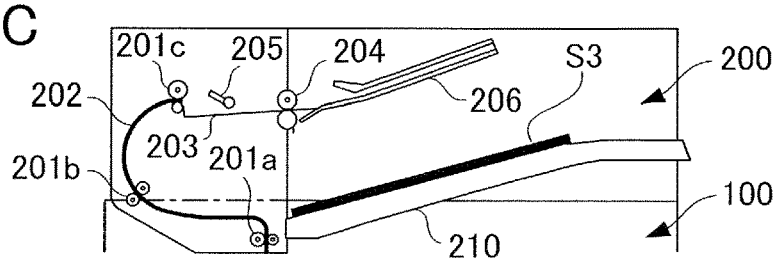
FIG. 10C is a side view illustrating a state where a sheet is supported on a discharging tray in the stacking mode.

As illustrated in FIGS. 10B and 10C, in the stacking mode, when a sheet discharging job is inputted, the discharging tray 210 is selected as a destination of the discharged sheet. In the stacking mode, the sheet S3 supported on the intermediate tray 203 is discharged to the discharging tray 210 by the discharging roller pair 204. When the job is completed, the sheet S3 is supported on the discharging tray 210 in a state where the sheet S3 is not supported on the intermediate tray 203. More specifically, when the control portion 20 executes the stacking mode serving as a second mode, the discharging roller pair 204 enters the close state, and the aligning members 206 and 207 are positioned at the retracting position. In this state, the sheet S3 supported on the intermediate tray 203 is discharged to the discharging tray 210 by the discharging roller pair 204. Here, the aligning members 206 and 207 may be positioned not at the retracting position but at the sheet receiving position until the trailing edge of the sheet S3 under the discharge passes through the discharging roller pair 204. In addition, the discharging roller pair 204 may be in the open state, provided that the discharging roller pair 204 is in the close state while the discharging roller pair 204 is discharging the sheet S3.

Figure 10D:
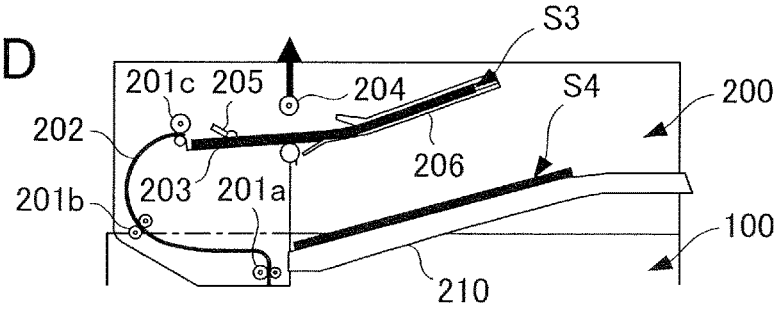
FIG. 10D is a side view illustrating a state where sheets are supported on the discharging tray, an intermediate tray, and the aligning members.
Figure 10E:
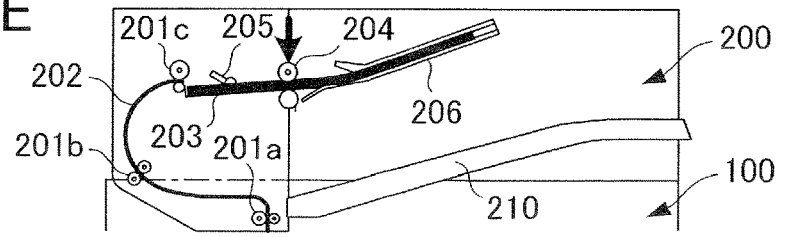
FIG. 10E is a side view illustrating a state where the holding mode is being released.
Figure 11:
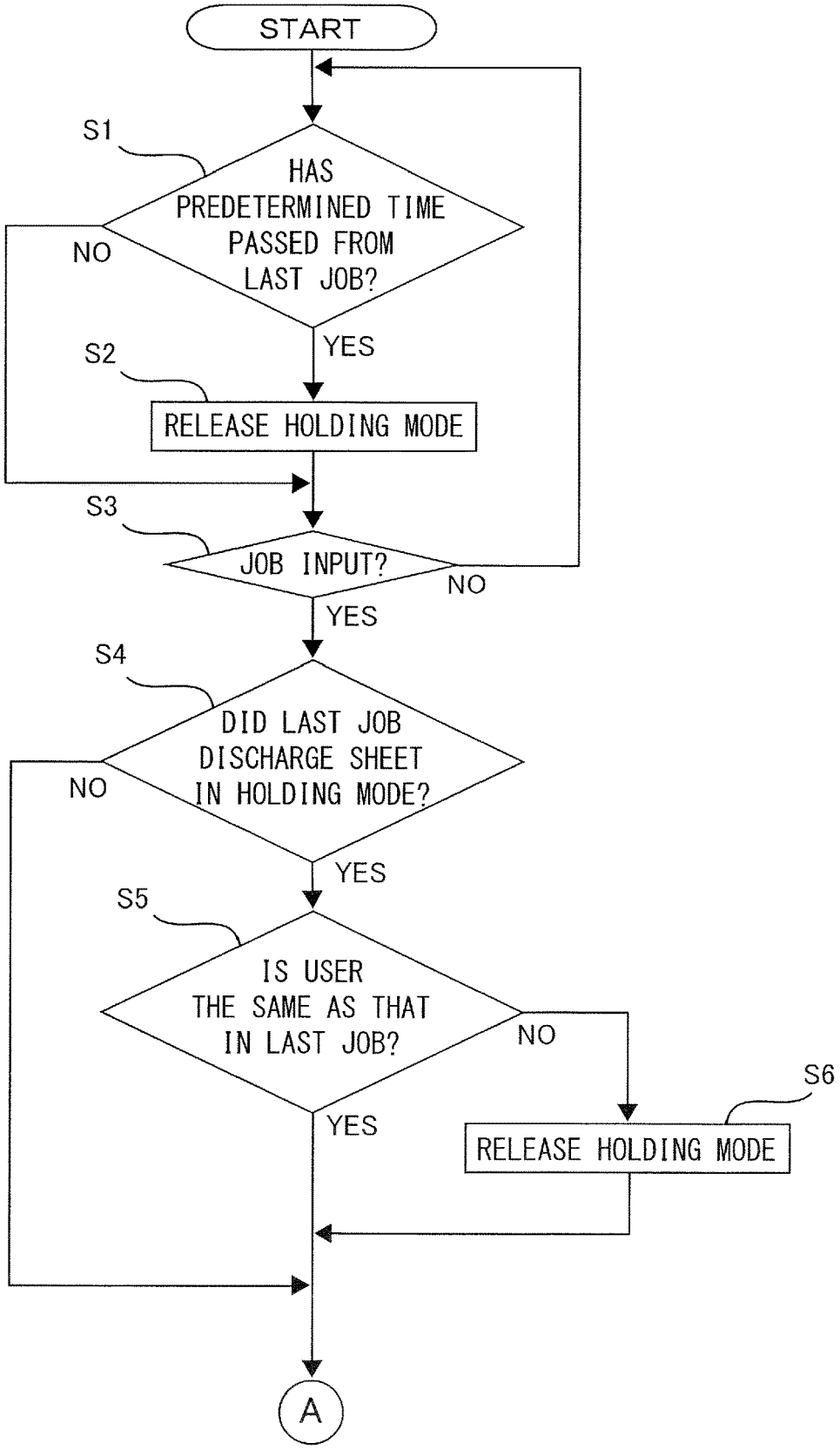
FIG. 11 is a flowchart illustrating processes related to the holding mode and the stacking mode.

Next, with reference to the flowchart illustrated in FIGS. 11 and 12, processes related to the holding mode and the stacking mode will be described. As illustrated in FIG. 11, the control portion 20 (see FIG. 5) determines whether a predetermined time has elapsed from the last job which discharged a sheet to the sheet processing apparatus 200 (Step S1). If the control portion 20 determines that the predetermined time has elapsed, that is, a job to discharge a sheet is not inputted during the predetermined time (Step S1: YES), then the control portion 20 releases the holding mode (Step S2). As illustrated in FIGS. 10E and 10C, when the holding mode is released, the aligning members 206 and 207 are positioned at the retracting position, and a sheet supported on the intermediate tray 203 is discharged to the discharging tray 210 by the discharging roller pair 204. Thus, in a case where the holding mode was executed in the above-described last job, the sheet supported on the intermediate tray 203 and the aligning members 206 and 207 is conveyed to the discharging tray 210 in Step S2.

If the predetermined time has not elapsed from the last job which discharged a sheet to the sheet processing apparatus 200 (Step S1: NO), or if the holding mode is released (Step S2), then the control portion 20 proceeds to Step S3. Then the control portion 20 determines whether a new (succeeding) job to discharge a sheet is inputted (Step S3). If the succeeding job is not inputted (Step S3: NO), then the control portion 20 returns to Step S1. If the succeeding job is inputted (Step S3: YES), then the control portion 20 determines whether the holding mode was executed in the preceding job (Step S4). The preceding job, which is a first job, is a job performed immediately before the succeeding job, which is a second job. If the holding mode was executed in the preceding job (Step S4: YES), then the control portion 20 determines whether user information associated with the preceding job is equal to user information associated with the succeeding job (Step S5).

If the user information associated with the preceding job is not equal to the user information associated with the succeeding job (Step S5: NO), the control portion 20 releases the holding mode (Step S6). The operation performed when the holding mode is released is the same as that in Step S2. If the preceding job was executed in the stacking mode (Step S4: NO), if the user information associated with the preceding job is equal to the user information associated with the succeeding job (Step S5: YES), or if the holding mode is released in Step S6, the control portion 20 determines whether the sheet sensor SE1 is ON or OFF (Step S7).

Figure 12:
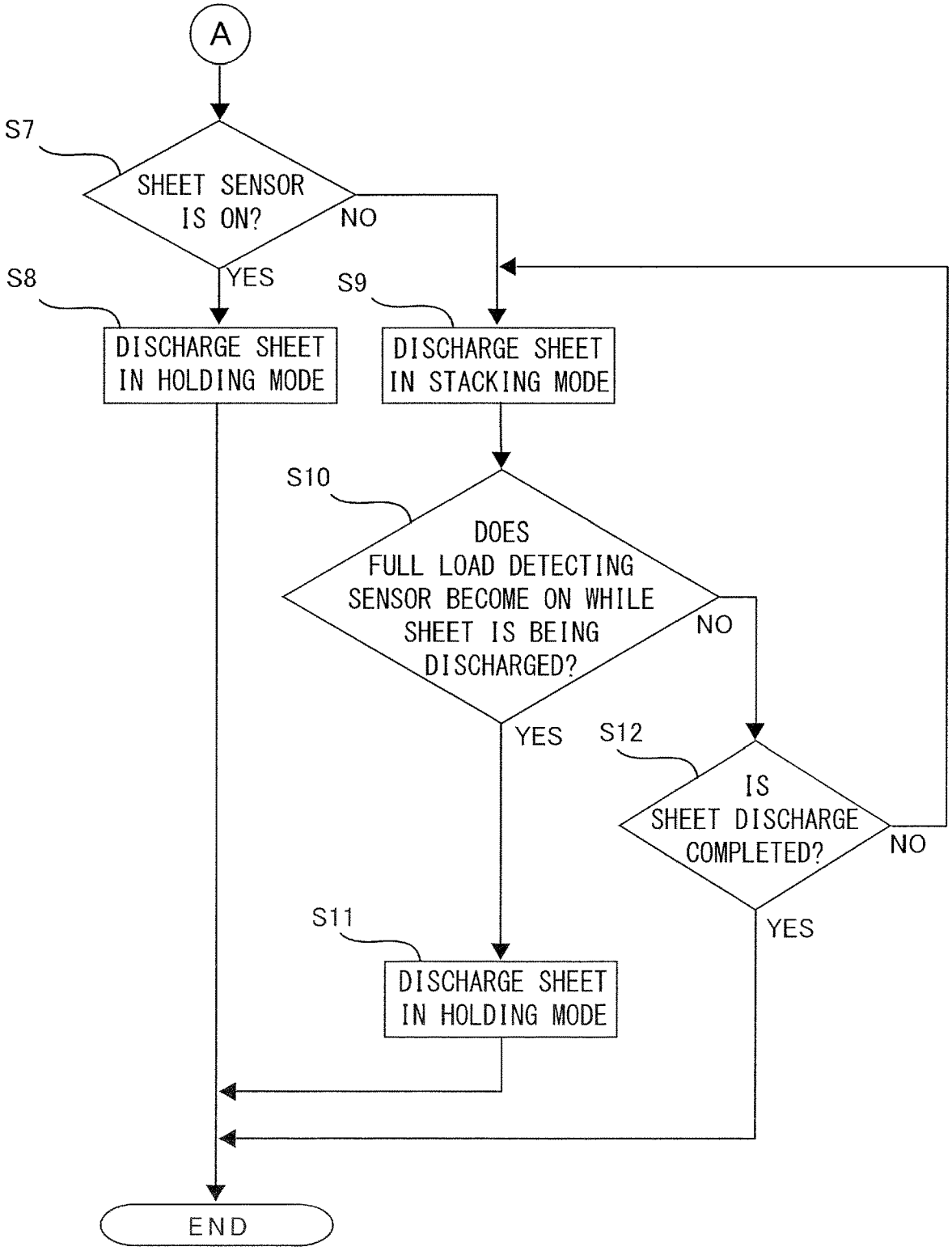
FIG. 12 is a flowchart illustrating processes related to the holding mode and the stacking mode.

As illustrated in FIG. 12, if the sheet sensor SE1 is ON, that is, if a sheet is supported on the discharging tray 210 (Step S7: YES), then the control portion 20 executes the holding mode. With this operation, as illustrated in FIG. 10D, while a sheet S4 discharged in the preceding job is supported on the discharging tray 210, a sheet S3 can be discharged to and supported on the intermediate tray 203 and the aligning members 206 and 207.

If the sheet sensor SE1 is OFF, that is, if any sheet is not supported on the discharging tray 210 (Step S7: NO), then the control portion 20 executes the stacking mode (Step S9). Then, if the full load detecting sensor SE2 becomes ON while sheets are being discharged in the stacking mode, that is, if sheets are fully stacked on the discharging tray 210 (Step S10: YES), then the control portion 20 switches the mode from the stacking mode to the holding mode (Step S11). With this operation, even when sheets are fully stacked on the discharging tray 210, the control portion 20 allows another sheet to be discharged to the intermediate tray 203 and the aligning members 206 and 207 instead of the discharging tray 210, without stopping the sheet discharging operation.

If the full load detecting sensor SE2 is OFF, that is, if sheets are not fully stacked on the discharging tray 210 (Step S10: NO), then the control portion 20 determines whether the sheet discharging operation is completed in the job (Step S12). If the sheet discharging operation is not completed (Step S12: NO), then the control portion 20 returns to Step S9. If the sheet discharging operation is completed (Step S12: YES), then the control portion 20 completes the process.

As described above, in the present embodiment, while a sheet discharged in the preceding job is supported on the discharging tray 210, another sheet can be discharged, in the next job, to the intermediate tray 203 and the aligning members 206 and 207. In addition, when sheets are fully stacked on the discharging tray 210, the control portion 20 allows another sheet to be discharged to the intermediate tray 203 and the aligning members 206 and 207, without stopping the job. Thus, even when the aligning process and the binding process are not performed on sheets, the present embodiment allows the intermediate tray 203 and the aligning members 206 and 207 to support sheets, and thus can effectively use the intermediate tray 203 and the aligning members 206 and 207. For example, sheets more than a stacking capacity of the discharging tray 210 can be supported on using the intermediate tray 203 and the aligning members 206 and 207.

In addition, when user information associated with the preceding job is not equal to the user information associated with the succeeding job, the control portion 20 releases the holding mode, and then allows a sheet of the succeeding job to be discharged to the intermediate tray 203 and the aligning members 206 and 207. Thus, as illustrated in FIG. 10D, the sheet S4 of a user on which printing is performed in the preceding job is not mixed with the sheet S3 of another user on which printing is performed in the succeeding job. This improves usability. Here, in the present embodiment, the holding mode is released only when user information associated with the preceding job is not equal to user information associated with the succeeding job. However, the holding mode may be released, regardless of the agreement of user information. In addition, in the present embodiment, the holding mode is executed when the sheet sensor SE1 is ON. However, the sheet sensor SE1 may not be provided. Moreover, when a plurality of jobs to discharge sheets are inputted, the control portion 20 may execute jobs other than the last job (of the plurality of jobs) in the stacking mode, and execute only the last job in the holding mode. Also in this case, since a sheet of a user who inputted the last job is not mixed with sheets of other users who inputted the other jobs, usability can be improved.

In addition, in the present embodiment, the holding mode is released, for example, when a predetermined time has elapsed from the last job. However, the holding mode may not be released when the full load detecting sensor SE2 is ON, even though the predetermined time has elapsed. Furthermore, in the present embodiment, the above-described processes are performed, as illustrated in the flowchart of FIGS. 11 and 12. However, other processes may be performed using the holding mode and the stacking mode. Thus, the use of the holding mode and the stacking mode can effectively use the intermediate tray 203 and the aligning members 206 and 207.

Second Embodiment

Next, a second embodiment of the present invention will be described. The second embodiment has a configuration in which the aligning members 206 and 207 of the first embodiment are not provided. Thus, the same components as those of the first embodiment are omitted in the drawings, or described with the same symbols given to the drawings.

Figure 13A:
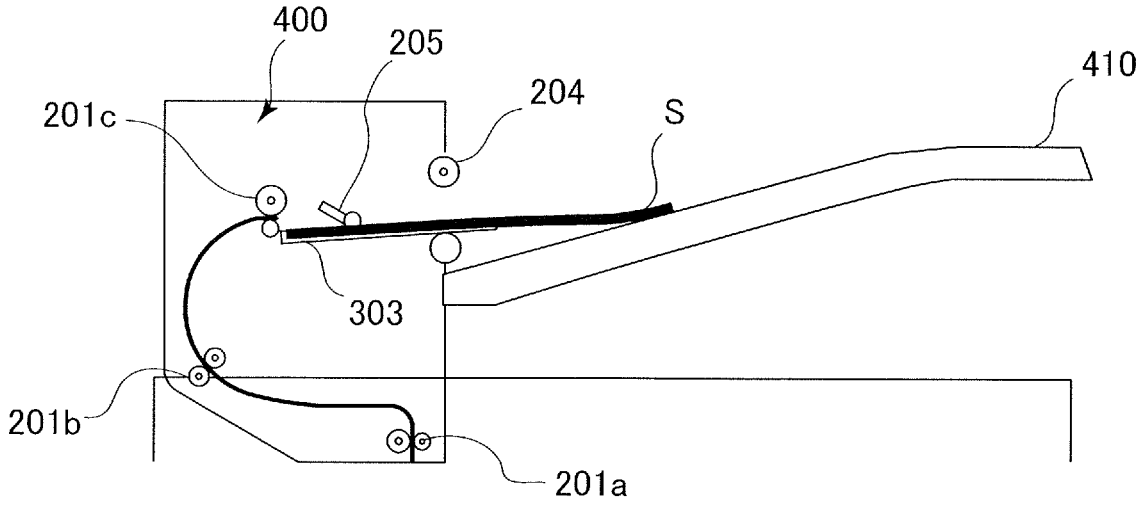
FIG. 13A is a side view for illustrating a holding mode of a second embodiment.
Figure 13B:
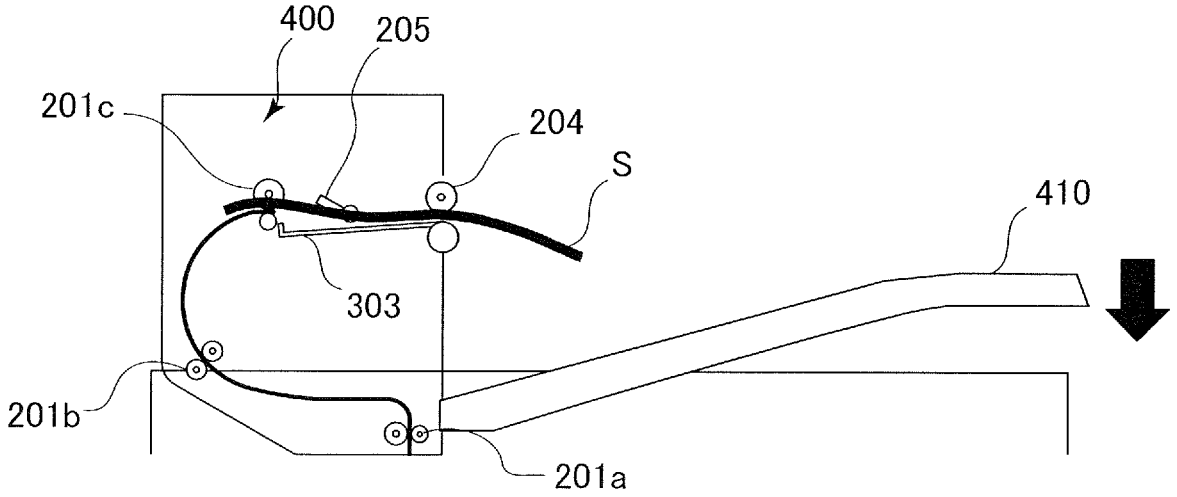
FIG. 13B is a side view for illustrating a stacking mode of the second embodiment.

In the second embodiment, a discharging tray 410 is provided so that the discharging tray 410 can move between a first position illustrated in FIG. 13A and a second position illustrated in FIG. 13B. In the holding mode, when a sheet discharging job (for example, an image forming job which discharges a sheet to a sheet processing apparatus 400) is inputted, the sheet is supported on an intermediate tray 303 and the discharging tray 410. More specifically, when the holding mode which is a first mode is executed, the discharging roller pair 204 enters the open state, and the discharging tray 410 is positioned at the first position. In this state, a sheet S is discharged by the conveyance roller pair 201*c* to the intermediate tray 303 and the discharging tray 410. In this time, at least a part of the sheet S, supported on the intermediate tray 303 and the discharging tray 410, is exposed to the outside. Thus, the sheet S can be taken out by a user.

In the stacking mode, when a sheet discharging job is inputted, the sheet S supported on the intermediate tray 303 is discharged to the discharging tray 410 by the discharging roller pair 204, and the sheet S is supported on the discharging tray 410 in a state where the sheet S is not supported on the intermediate tray 303. More specifically, when the stacking mode which is a second mode is executed, the discharging roller pair 204 enters the close state, and the discharging tray 410 is positioned at the second position. In this state, the sheet S supported on the intermediate tray 303 is discharged to the discharging tray 410 by the discharging roller pair 204.

The processes related to the holding mode and the stacking mode are the same as those in the flowchart of FIGS. 11 and 12 of the first embodiment, and thus the description thereof will be omitted. In the second embodiment, when the holding mode is released, the discharging tray 410 moves down from the first position to the second position, and the sheet S on the intermediate tray 303 is discharged to the discharging tray 410 by the discharging roller pair 204. As described above, the second embodiment can produce the same effects as those of the first embodiment by providing the discharging tray 410 so as to move up and down, instead of the aligning members 206 and 207.

Third Embodiment

Figure 14A:
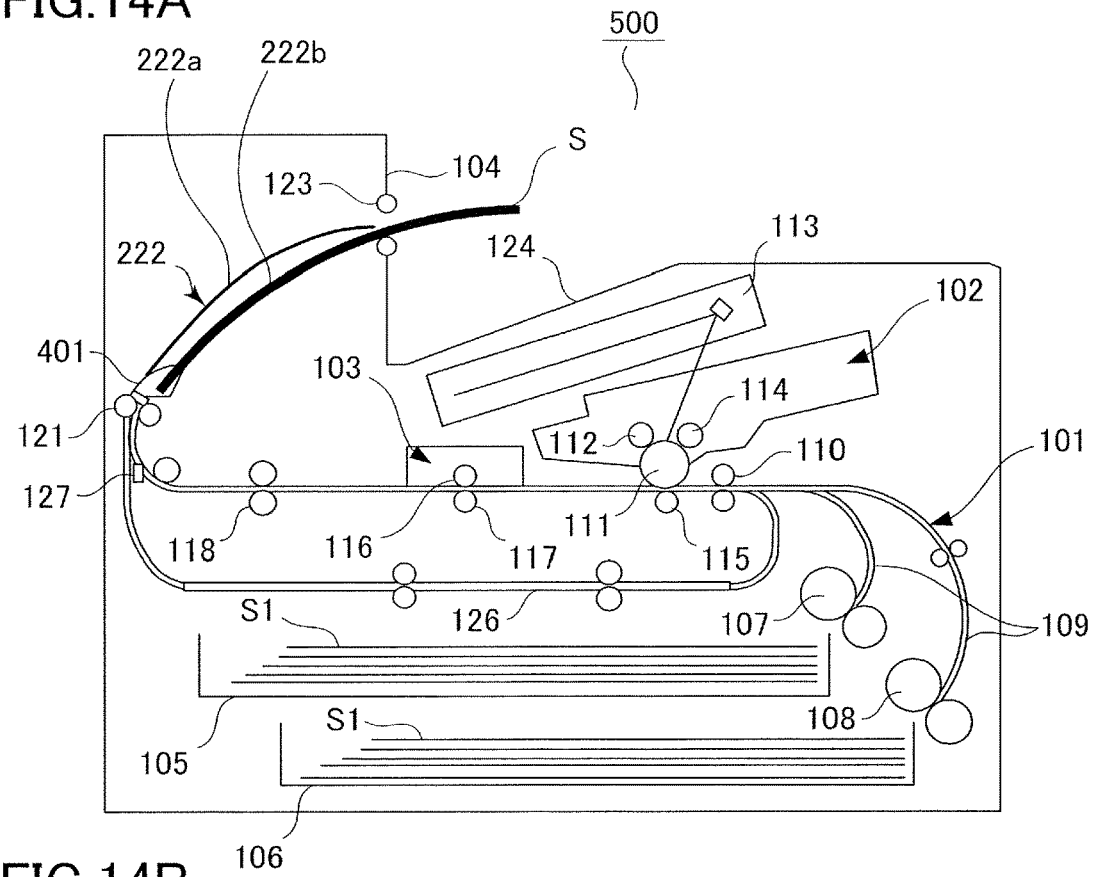
FIG. 14A is a side view for illustrating a holding mode of a third embodiment.

Next, a third embodiment of the present invention will be described. The third embodiment has a configuration in which the holding mode and the stacking mode are achieved not by the sheet processing apparatus but by an image forming apparatus body 500. Thus, the same components as those of the first embodiment are omitted in the drawings, or described with the same symbols given to the drawings As illustrated in FIG. 14A, the image forming apparatus body 500 includes an upper guide 222*a*, a lower guide 222*b*, and a trailing-edge supporting portion 401. The upper guide 222*a* and the lower guide 222*b* guide the sheet S to the discharging roller pair 123, and the trailing-edge supporting portion 401 supports the trailing edge of the sheet S which is in contact with the lower guide 222*b*. The lower guide 222*b*, which is a guide member, and the trailing-edge supporting portion 401 constitute a supporting unit 222 which is a first supporting portion. The trailing-edge supporting portion 401 can move between a non-interference position at which the trailing-edge supporting portion 401 does not interfere with the sheet which is being conveyed, and a supporting position at which the trailing-edge supporting portion 401 supports the trailing edge of the sheet. In the third embodiment, the discharging tray 124 disposed in the body is a second supporting portion.

In the holding mode, when a sheet discharging job (for example, an image forming job which discharges a sheet to the discharging tray 124 disposed in the body) is inputted, the sheet S is supported on the supporting unit 222. More specifically, when the holding mode which is a first mode is executed, the discharging roller pair 123 which is a discharging portion enters the open state, and the sheet S is conveyed to the supporting unit 222 by the reversing roller pair 121. After the trailing edge of the sheet S, conveyed by the reversing roller pair 121, passes the trailing-edge supporting portion 401, the trailing-edge supporting portion 401 moves to the supporting position to support the trailing edge of the sheet S. The length of the lower guide 222*b* in the sheet discharging direction is shorter than the length of a minimum-size sheet which is applicable for the image forming apparatus body 500. Consequently, at least a part of the sheet S supported on the supporting unit 222 is exposed to the outside. Thus, the sheet S supported on the supporting unit 222 can be taken out by a user.

Figure 14B:
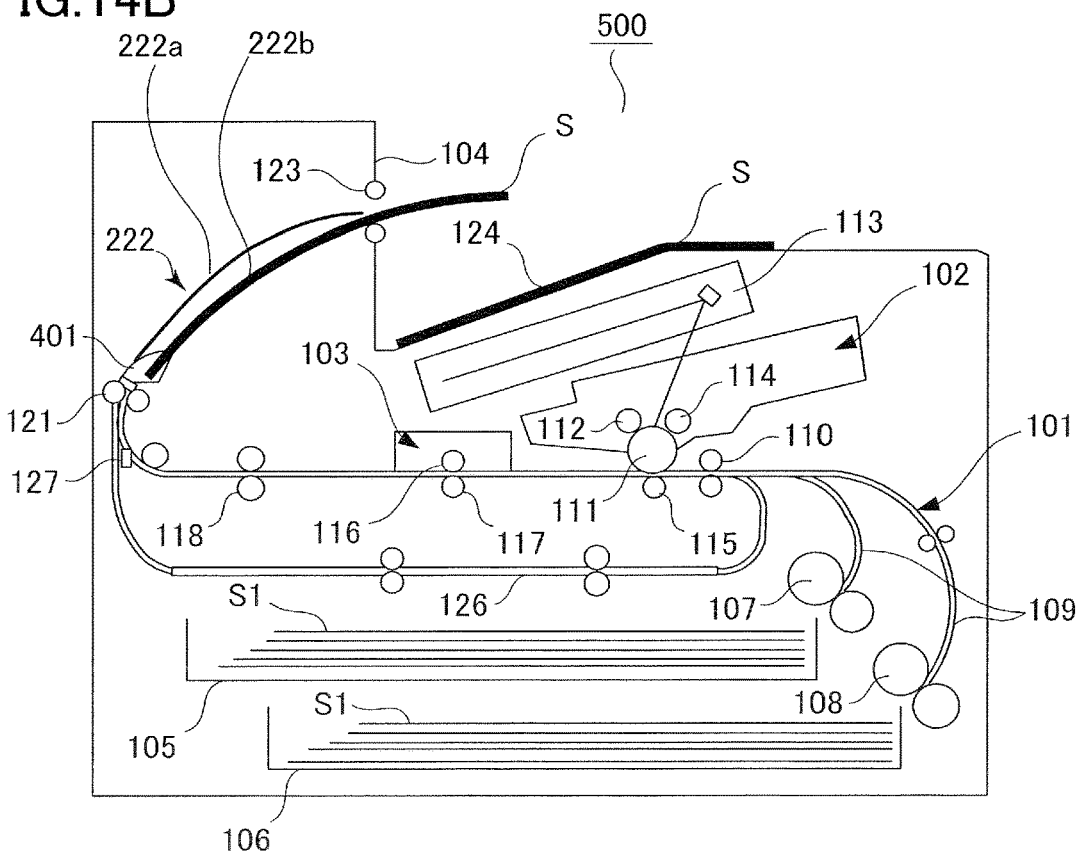
FIG. 14B is a side view for illustrating a stacking mode of the third embodiment.

As illustrated in FIG. 14B, in the stacking mode, when a sheet discharging job is inputted, the sheet S supported on the supporting unit 222 is discharged to the discharging tray 124 disposed in the body, by the discharging roller pair 123. Furthermore, the sheet S is supported on the discharging tray 124 disposed in the body, in a state where the sheet S is not supported on the supporting unit 222. More specifically, when the stacking mode which is a second mode is executed, the discharging roller pair 123 enters the close state, and the trailing-edge supporting portion 401 is positioned at the non-interference position. In this state, the sheet S supported on the lower guide 222*b* is discharged to the discharging tray 124 disposed in the body, by the discharging roller pair 123.

The processes related to the holding mode and the stacking mode are the same as those in the flowchart of FIGS. 11 and 12 of the first embodiment, and thus the description thereof will be omitted. In the third embodiment, when the holding mode is released, the discharging roller pair 123 enters the close state, the sheet S supported on the lower guide 222*b* is discharged to the discharging tray 124 disposed in the body, by the discharging roller pair 123. As can be seen from the above, the image forming apparatus body 500 can also produce the same effects as those of the first embodiment.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-250192, filed Dec. 26, 2017, which is hereby incorporated by reference herein in its entirety.

What is claimed is:

1. A sheet discharging apparatus comprising:

a discharging portion configured to discharge a sheet in a sheet discharging direction;

a first supporting portion configured to support the sheet in a state where at least a part of the sheet is exposed to an outside;

a second supporting portion disposed downstream of the first supporting portion in the sheet discharging direction and configured to support the sheet discharged by the discharging portion; and a control portion configured to execute a first mode and a second mode, the first mode being a mode where the first supporting portion is selected as a destination of the discharged sheet and where the first supporting portion supports the sheet, the second mode being a mode where the second supporting portion is selected as the destination of the discharged sheet and where the second supporting portion supports the sheet by discharging the sheet supported on the first supporting portion to the second supporting portion by the discharging portion in a state where the sheet is not supported on the first supporting portion.

2. The sheet discharging apparatus according to claim 1, wherein the discharging portion comprises a first discharging portion configured to discharge the sheet to the first supporting portion, and a second discharging portion configured to discharge the sheet discharged by the first discharging portion to the second supporting portion, wherein the second discharging portion is a rotary member pair configured to transition between a first state where the rotary member pair is configured to hold the sheet and a second state where the rotary member pair is configured not to hold the sheet, and wherein the second discharging portion enters the first state in a case where the control portion executes the second mode, and enters the second state in a case where the control portion executes the first mode.

3. The sheet discharging apparatus according to claim 1, wherein in a case where a plurality of jobs to discharge sheets is inputted, the control portion executes the second mode in jobs of the plurality of jobs other than a last job, and executes the first mode in the last job of the plurality of jobs.

4. The sheet discharging apparatus according to claim 1, further comprising a sheet sensor configured to detect whether the sheet is supported on the second supporting portion, wherein in a case where a sheet discharging job is inputted, the control portion executes the first mode when the sheet sensor detects that the sheet is supported on the second supporting portion, and executes the second mode when the sheet sensor detects that the sheet is not supported on the second supporting portion.

5. The sheet discharging apparatus according to claim 1, wherein in a case where the control portion executes the first mode in a first job to discharge a sheet, and where a second job to discharge a sheet is inputted after the first job, the control portion causes the discharging portion to discharge a sheet supported on the first supporting portion to the second supporting portion.

6. The sheet discharging apparatus according to claim 1, wherein in a case where a second job to discharge a sheet is sequentially inputted after a first job to discharge a sheet and where the control portion has executed the first mode in the first job, the control portion causes the discharging portion to discharge a sheet supported on the first supporting portion to the second supporting portion if user information associated with the first job is not equal to user information associated with the second job.

7. The sheet discharging apparatus according to claim 1, wherein in a case where a sheet discharging job is not inputted during a predetermined time, the control portion causes the discharging portion to discharge a sheet supported on the first supporting portion to the second supporting portion.

8. The sheet discharging apparatus according to claim 1, further comprising a full load detecting sensor configured to detect that sheets are fully stacked on the second supporting portion, wherein in a case where the full load detecting sensor detects that sheets are fully stacked on the second supporting portion while the control portion is executing the second mode, the control portion changes the second mode to the first mode.

9. The sheet discharging apparatus according to claim 1, further comprising a pair of aligning members configured to move relative to each other in a width direction orthogonal to the sheet discharging direction, and align a position of a sheet supported on the first supporting portion in the width direction, wherein each of the aligning members comprises an abutment surface configured to contact an edge of a sheet in the width direction and a lower-surface supporting portion configured to support a lower surface of the sheet which is in contact with the abutment surface, wherein the pair of aligning members is positioned at a holding position in a case where the control portion executes the first mode, and positioned at a separation position in a case where the control portion executes the second mode, wherein the holding position is a position at which the lower-surface supporting portion holds a sheet supported on the first supporting portion, and wherein the separation position is a position at which the lower-surface supporting portion is positioned outside, in the width direction, of a sheet which is being discharged.

10. The sheet discharging apparatus according to claim 1, wherein the second supporting portion is configured to move between a first position and a second position separated further than the first position from the first supporting portion, wherein in a case where the control portion executes the first mode, the second supporting portion is positioned at the first position to support a sheet together with the first supporting portion, and wherein in a case where the control portion executes the second mode, the second supporting portion is positioned at the second position.

11. The sheet discharging apparatus according to claim 1, wherein the first supporting portion is a tray configured to support a sheet.

12. The sheet discharging apparatus according to claim 1, wherein the first supporting portion comprises a guide member configured to guide a sheet toward the sheet discharging direction and a trailing-edge supporting portion configured to support a trailing edge of a sheet which is in contact with the guide member.

13. The sheet discharging apparatus according to claim 1, wherein a length of the first supporting portion is shorter, in the sheet discharging direction, than a length of a minimum-size sheet which is applicable for the sheet discharging apparatus.

14. The sheet discharging apparatus according to claim 1, further comprising a processing portion configured to process a sheet supported on the first supporting portion.

15. An image forming apparatus comprising:

an image forming portion configured to form an image on a sheet; and the sheet discharging apparatus according to claim 1 and configured to discharge the sheet on which the image is formed by the image forming portion.

16. The image forming apparatus according to claim 15, wherein in a case where the control portion executes the first mode in an image forming job to form an image on a sheet by the image forming portion, the first supporting portion supports a sheet discharged by the discharging portion when the image forming job is completed.

* * * * *